United States Patent [19]

Mikoshiba et al.

[11] 4,387,643

[45] Jun. 14, 1983

[54] SMALL PRINTER

[75] Inventors: Hitoshi Mikoshiba; Kazuyoshi Fujimori; Kenji Onodera; Shin Takeuchi, all of Shiojiri, Japan

[73] Assignees: Shinshu Seiki Kabushika Kaisha; Kabushiki Kaisha Suwa Seikosha, both of Tokyo, Japan

[21] Appl. No.: 334,628

[22] Filed: Dec. 28, 1981

[30] Foreign Application Priority Data

Dec. 29, 1980 [JP] Japan ..... 55-187622

[51] Int. Cl.[3] ..... B41J 1/44

[52] U.S. Cl. ..... 101/110

[58] Field of Search ..... 101/109–111, 101/85, 72–77, 79, 88–89, 91, 95–97, 45, 93.22, 99, 93.21

[56] References Cited

U.S. PATENT DOCUMENTS

| | | | |
|---|---|---|---|
| 3,465,670 | 9/1969 | Belson et al. | 101/93 |
| 3,848,527 | 11/1974 | Nihira | 101/93 |
| 3,890,894 | 5/1975 | Nihira | 101/93.18 |
| 3,954,055 | 5/1976 | Hanaoka | 101/99 |
| 4,033,256 | 7/1977 | Hanaoka | 101/99 |
| 4,054,089 | 10/1977 | Okabe | 101/110 |
| 4,104,967 | 8/1978 | Okabe | 101/99 |
| 4,142,463 | 3/1979 | Mitsui et al. | 101/99 |
| 4,164,181 | 8/1979 | Hanaoka | 101/110 X |
| 4,321,867 | 3/1982 | Soderberg et al. | 101/91 |
| 4,343,238 | 8/1982 | Koch | 101/85 |

*Primary Examiner*—E. H. Eickholt

*Attorney, Agent, or Firm*—Blum, Kaplan, Friedman, Silberman & Beran

[57] ABSTRACT

A small printer using character wheels is provided. The printer includes a plurality of character wheels frictionally mounted on a shaft for rotation therewith and having a ratchet wheel on side surface. Associated with each character wheel is a pivotable selector pawl actuatable by an electromagnet. The number of electromagnets is less than the number of selector pawls and character wheels. Stopper cams are actuatable into locking engagement with the ratchet wheels on even-numbered character wheels when the shaft begins to rotate. Only odd-numbered character wheels are caused to rotate with the shaft. The desired characters on the odd-numbered character wheels are selected when the electromagnets are energized selectively to move the selector pawls into locking engagement with the ratchets on the odd-numbered character wheels. During the next revolution of the shaft, the stoppers are retracted, that is, out of engagement with the ratchets on the even-numbered type wheels. Accordingly, the even-numbered character wheels are then caused to rotate with the shaft for selection.

11 Claims, 4 Drawing Figures

SMALL PRINTER

BACKGROUND OF THE INVENTION

This invention relates generally to a small printer having selectable character wheels with raised characters around the periphery thereof, and more particularly to an apparatus for controlling a plurality of character wheels with a single electromagnet. The prior art, for example, U.S. Pat. No. 3,848,527, discloses a mechanism for small printers which includes electromagnets which are less in number than the number of printed column positions. An electromagnet is provided for every three column positions, and a selecting roll is provided for controlling the electromagnet so as to select one character wheel at the desired column position. The selection roll makes one-third of a complete revolution in order to select a single character. Therefore, it is necessary that the selecting roll makes one entire revolution before it operates for the three column positions.

Assuming that it takes five milliseconds to select one character, the selecting roll completes one revolution in fifteen milliseconds. Hence, it is rotating at the high speed of four thousand revolutions per minute. Such high speed tends to cause the printer to produce vibrations and noises, and business machines incorporating such a printer have proven unsatisfactory in practical usage. Additionally, the raised characters on the character wheels are displaced for every three columns positions, a feature that prohibits use of character wheels fabricated by ejection molding a material in a common mold. Production of such character wheels requires three different molds and hence, is much more costly. Different molds are likely to produce character wheels having varying character positions resulting from the different molds and misaligned printed characters.

What is needed is a small printer having fewer electromagnets than character wheels, which operates with low vibration and noise and produces printed characters of high quality.

SUMMARY OF THE INVENTION

Generally speaking, in accordance with the invention, a small printer using character wheels especially suitable for printing with high quality and low vibration and noise is provided. The printer includes a plurality of character wheels frictionally mounted on a shaft for rotation therewith. Each character wheel has a plurality of raised characters on the peripheral circumferential surface thereof and a ratchet wheel on a side surface. Associated with each character wheel is a pivotable selector pawl actuatable by an electromagnet. The number of electromagnets is less than, and preferably half as many as the number of selector pawls and character wheels. As the character wheels rotate with the shaft, the selection of a character for printing is made by actuating the associated electromagnet causing the selector pawl to engage the ratchet wheel. Stopper cams are actuatable into locking engagement with the ratchet wheels on even-numbered character wheels when the shaft begins to rotate. Therefore, only odd-numbered character wheels are able and caused to rotate with the shaft. The desired characters on the odd-numbered character wheels are selected when the electromagnets are energized selectively to move the selector pawls into locking engagement with the ratchets on the odd-numbered character wheels. During the next revolution of the shaft, the stoppers are retracted, that is, out of engagement with the ratchets on the even-numbered type wheels. Accordingly, the even-numbered character wheels are then able and caused to rotate with the shaft. Energization of the electromagnets causes the selector pawls to engage the ratchets on the even-numbered character wheels, and desired characters on the even-numbered character wheels are selected. Thus, in two shaft revolutions, characters are selected on both the odd and even numbered character wheels.

Accordingly, it is an object of this invention to provide an improved small printer having a plurality of character wheels and associated electromagnets for selecting characters on the wheels, the number of electromagnets being less than the number of character wheels.

Another object of this invention is to provide an improved small printer which prints at high speed with low noise and vibration.

A further object of this invention is to provide an improved small printer which is stable and reliable in the selection of characters on the character wheels, and which prints characters of high quality.

Still another object of this invention is to provide an improved small printer which can be manufactured economically.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
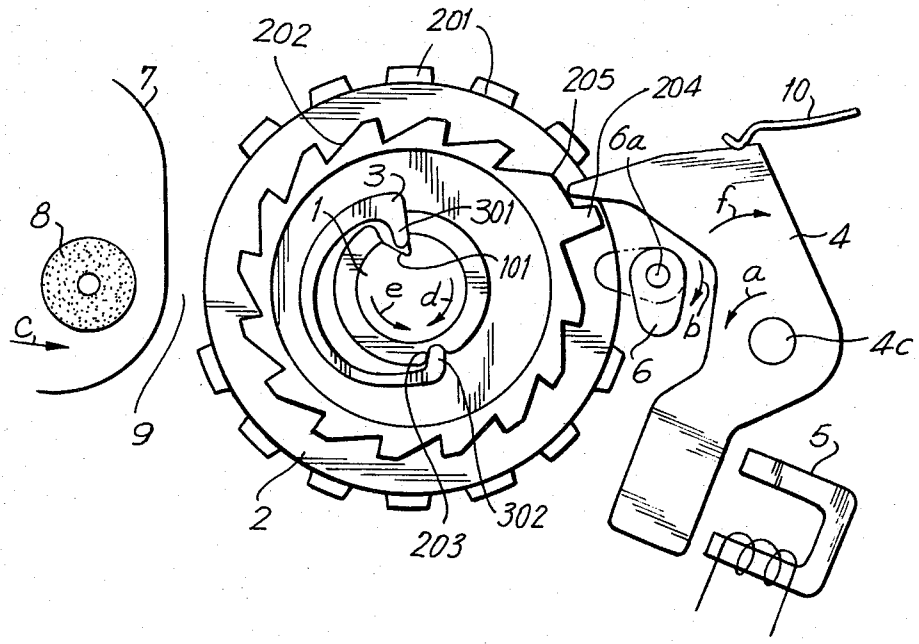
FIG. 1 is a partial side elevational view of a small printer in accordance with the invention.
Figure 2:
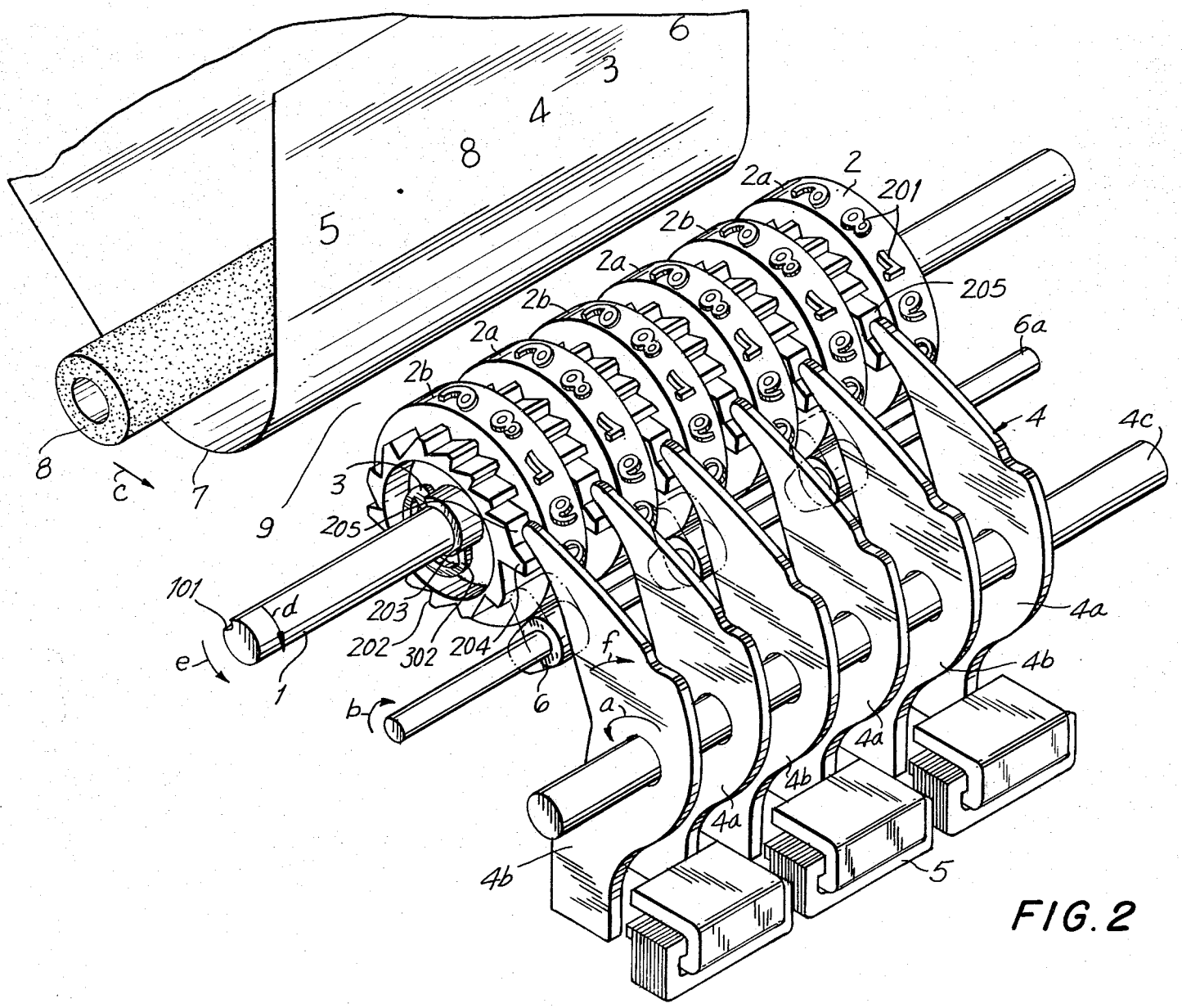
FIG. 2 is a perspective view of a small printer of FIG. 1.

With reference to FIGS. 1 and 2, a plurality of character wheels 2 are supported on a shaft 1 having a longitudinal slot 101 extending lengthwise along the shaft 1. Each character or type wheel 2 has a plurality of raised characters or symbols 201 around the peripheral, circumferential surface, and a selector ratchet wheel 202 is fixedly positioned on the side of each character wheel 2. The number of character wheels 2 provide the required number of column positions for printing on a printing sheet 7.

The ratchet wheels 202 have teeth corresponding in position to the raised characters 201 on the character wheel 2. A spring 3, generally C-shaped, has one end 301 engaged in the longitudinal slot 101 in the shaft 1, and the other end 302 of the spring 3 is engaged in a recess 203 in the character wheel 2. Each character wheel 2 is associated with as similar spring 3.

A plurality of selector pawls 4 are pivotably mounted on a shaft 4c for engagement, when pivoted, with the ratchet wheels 202 of the character wheels 2, respectively, so as to bring selected characters 201 into a printing position 9 opposed to the printing paper 7, as explained more fully hereinafter.

A plurality of electromagnets 5 are disposed adjacent to the selector pawls 4 for pivoting the selector pawls 4 in the direction of the arrow a (FIG. 1) upon energization of the associated electromagnet. A leaf spring 10, shown only in FIG. 1, engages each of the selector pawls 4 to hold the pawls 4 after they are pivoted in the direction of the arrow a. Each electromagnet 5 acts on two adjacent selector pawls 4 corresponding to two adjacent column positions for printing. Thus, in the illustrated embodiment, the required number of electromagnets 5 is only half as many as the number of selector pawls 4 or column positions.

A plurality of stoppers 6 are mounted on a shaft 6a for locking engagement with projections 204 on the ratchet wheel 202 of every other character wheel 2. When the stoppers 6 are rotated so as to interfere with the locus of travel of the projections 204, as the character wheels commence rotation, the character wheels having projections 204 are prevented from being rotated.

A printing means 8 is positioned parallel to the type wheels 2 movable toward the type wheels in the direction indicated by the arrow C for pressing a sheet 7 of printing paper against the selected characters 201 arranged in a single lateral row at the printing position 9.

Figure 3:
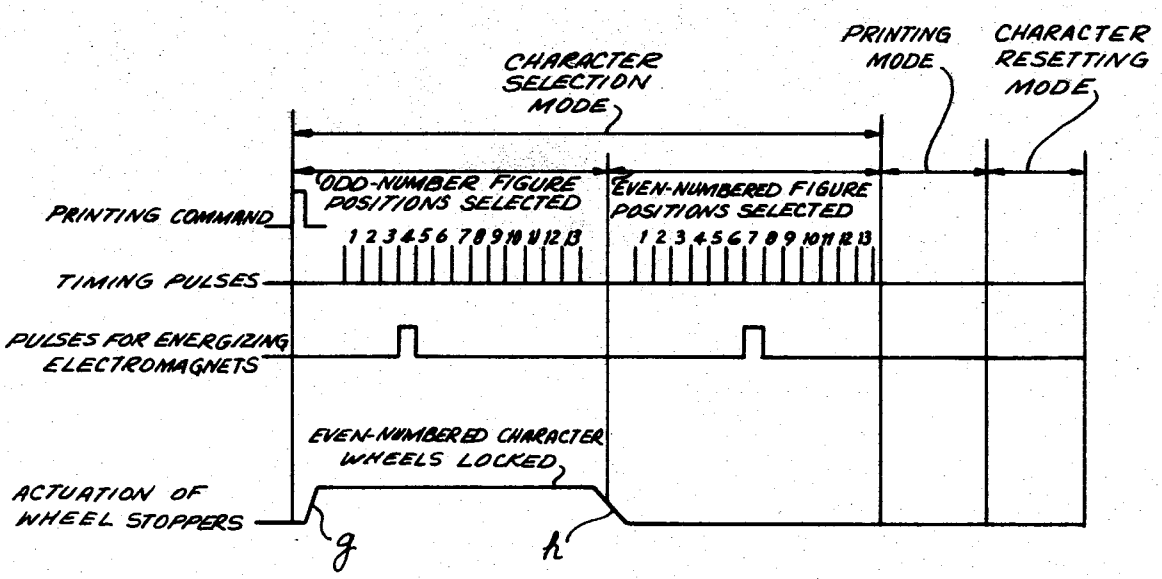
FIG. 3 is a timing chart illustrative of operations of the small printer of FIG. 1.

Operation of the printer of FIGS. 1 and 2 is described with reference to FIG. 3. The printer operates in three modes, that is, a character selection mode, a printing mode, and a character resetting mode. In the character selection mode of operation, a motor (not shown) is energized in response to a printing command causing rotation of the shaft 1 in the direction of the arrow d. At this time, a cam (not shown) is actuated to turn the stopper 6 in the direction of the arrow b to the position indicated in the FIGS. 1,2 by broken lines, that is, into the path of movement of the projections 204 on the even-numbered character wheels 2b.

As the shaft 1 continues to rotate, the even-numbered character wheels 2b are prevented by the stoppers 6 from rotating with the shaft 1. In the process, the ends 301 of the springs 3 rise out of the slot 101 in the shaft 1 such that the shaft 1 continues to rotate without damage to the even-numbered character wheels 2b. The odd-numbered character wheels 2a are caused to rotate with the shaft because the springs 3 are held in engagement with both the shaft 1 and the recess 203 on the character wheel 2.

The shaft 1 is equipped with a detector (not shown) for producing timing pulses upon rotation of the shaft 1 so as to detect the rotating position of the characters 201. When a desired character 201 on an odd-numbered character wheel 2a is located just in front of the printing position 9, the corresponding associated electromagnet 5 is energized in synchronization with a timing pulse, causing the corresponding odd-numbered selector pawl 4a to pivot in the direction of the arrow a. Thereupon, the distal end of the selector pawl 4a engages the ratchet wheel 202 on the associated character wheel 2 to stop the character wheel 2. Even-numbered selector pawls 4b have their distal ends riding on lands 205 on the ratchet wheels 202 and thus are positioned radially away from the teeth of the ratchet wheels 202 of the even-numbered type wheels 2b. Hence, the selector pawls 4b are prevented from pivoting in the direction of the arrow a upon energization of the electromagnets 5 when the stoppers lock the associated character wheels 2. Therefore, only the odd numbered character wheels 2a can be selected at this time before the shaft completes one revolution.

When the ends 301 of the springs 3 attached to the even numbered character wheels 2b are allowed to drop once more into the slot 101 in the shaft 1, the shaft 6a is rotated back, returning the stopper 6 to a position (solid lines) out of engagement with the projections 204 on the ratchet wheels 202. Continued rotation of the shaft 1 for a second revolution of the character wheels, causes the even-numbered type wheels 2b, which are now unlocked, to rotate with the shaft 1 because the ends 301 of the springs 3 are received and engaged in the slot 101.

During the second revolution of the shaft 1, the odd-numbered character wheels 2a are prevented from rotation by the selector pawls 4a which engage the ratchet wheels 202 of the odd-numbered type wheels 2a. Desired characters 201 on the even-numbered type wheels 2b are selected in response to energization of the electromagnets 5 in the same manner as described above for selection of desired characters 201 on the odd-numbered character wheels 2a. When the shaft 1 has completed two revolutions, the desired characters 201 on both the odd and even character wheels 2a,2b have been selected and locked at the printing position 9. The type selection mode of operation is thus finished.

In the succeeding printing mode of operation, the printing means is moved in the direction of the arrow c to press the printing sheet 7 uniformly against the characters 201 at the print position 9, whereby selected characters are printed on the printing sheet 7. The shaft 1 is held so as to prevent rotation during the printing mode of operation. Printing of characters may be effected by either an ink roll which presses against the raised characters 201 or by an ink ribbon (positioned between the raised characters 201 and the printing sheet 7).

In the character resetting mode of operation, the shaft 1 is rotated in the reverse direction, that is, in the direction of the arrow e. As the shaft 1 is rotated, the ends 301 of the springs 3 drop successively into the slot 101 in the shaft to cause the type wheels 2 to rotate with the shaft 1 until all of the type wheels 2 are brought back to their starting position. Then, the selector pawls 4 are caused by the lands 205 of the ratchet wheels 202 to pivot in the direction of the arrow f, thereby displacing the distal ends of the selector pawls 4 out of engagement with the ratchet wheels 202. The odd and even-numbered type character wheels 2a,2b are all reset while the shaft 1 makes approximately one revolution.

With this construction of a small printer in accordance with the invention, a single electromagnet 5 is used to select characters on two adjacent character wheels 2, an odd-numbered wheel and an even-numbered wheel 2a,2b during the type selection mode of operation. Accordingly, half as many expensive electromagnets 5 are required as there are character wheels 2. All desired characters are selected while the shaft 1 makes approximately two revolutions. Characters on the odd-numbered type wheels 2a are selected during the first revolution of the shaft 1 and those characters on the even-numbered type wheels 2b are selected during the next revolution of the shaft 1 under control of the stopper 6.

The stoppers 6, as stated, are selectively engageable with every other character wheel 2. It is necessary to actuate the stopper 6 only two times, that is, before the shaft 1 starts to rotate as indicated at g in FIG. 3, and when the shaft starts to make a second revolution as indicated at h in FIG. 3. Thus, the stopper 6 produce much less vibration and noise during operation than in small printers of the prior art.

When the electromagnets 5 are energized to actuate the selector pawls 4, the even-numbered pawl 4*a* are held against the lands 205 and prevented from being pivoted in the direction of the arrow a, while at the same time the odd-numbered pawls 4*b* are actuated selectively to select the desired characters 201. Therefore, the electromagnets 5, during the first revolution of the shaft 1 are required to actuate only the odd-numbered selector pawls 4*a* and are not subjected to loads which would otherwise be imposed by the inertia of the full array of selector pawls 4*a*,4*b*. The selector pawls 4 are actuated in a short period of time, in a stable manner and without failure. The character wheels 2 used for all column positions are of the same configuration and can be molded inexpensively using one mold. The raised characters 201 on such character wheels 2 are uniform and hence, print characters which are positionally aligned or neatly arranged in a row, and are of high quality.

Whereas in the illustrated embodiment of FIGS. 1,2, the even-numbered type wheels 2*b* are prevented from rotation during the first revolution of the shaft 1, the character wheels may be rendered freely rotatable. This arrangement causes no difficulty when desired characters on the odd-numbered character wheels 2*a* are selected while the shaft 1 makes one revolution. However, a mechanism is required for retracting the selector pawls 4*b* in the direction of the arrow f to move the distal ends thereof away from the path of movement of the projections 204. This allows the even-numbered type wheels 2*b* to rotate for selection of characters thereon while the shaft 1 makes a second revolution. Inclusion of such mechanism renders the printers complex in structure. Although in the illustrated embodiment, each electromagnet 5 spans two character wheels 2 or column positions, an electromagnet may be arranged to actuate three or four character wheels 2.

Figure 4:
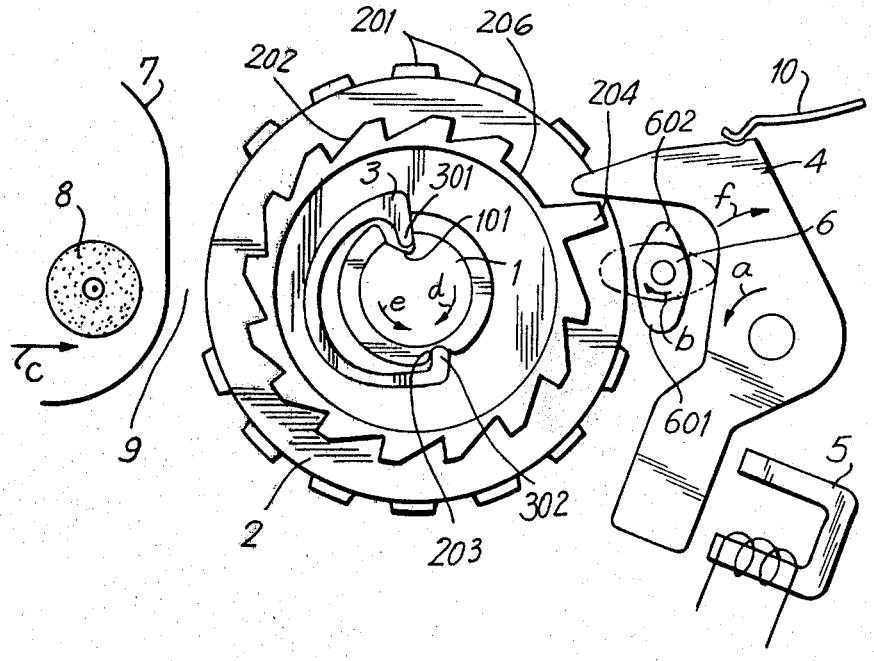
FIG. 4 is a partial side elevational view similar to FIG. 1 of an alternative embodiment of a small printer in accordance with the invention.

With reference to FIG. 4, an alternative embodiment of a small printer in accordance with the invention includes a ratchet wheel 202 having a recess 206 located adjacent to a projection 204 for receiving therein the distal end of a selector pawl 4. Components in the embodiment of FIG. 4 having the same function as in the embodiment of FIGS. 1,2 are given similar reference numerals. A ratchet wheel 202 associates with each character wheel 2.

A stopper 6 for locking an even-numbered character wheel 2 comprises a cam 601 for preventing the character wheel 2 from rotating, and a projection 602 for preventing an even-numbered pawl 4 from pivoting in the direction of the arrow a when the associated electromagnet 5 is energized. With this construction, while the shaft 1 makes the first revolution, the stopper 6 is angularly moved from the solid line position (FIG. 4) to the broken line position so as to enage the even-numbered type wheel 2 and to prevent rotation of that type wheel 2. Simultaneously the stopper 6 engages the even-numbered selector pawl 4 so as to prevent angular movement of the pawl 4 in the direction of the arrow a. Thus, energization of the electromagnet 5 causes only odd-numbered selector pawls 4 to turn in the direction of the arrow a, with even-numbered selector pawls 4 being retained by stoppers 6 against such angular movement. Thus, both the even-numbered character wheels 2 and the associated selector pawls 4 are prevented from motion. Thus, the projection 602 (FIG. 4) is a functional equivalent of the land 205 shown in FIGS. 1 and 2.

On the second rotation of the shaft, the stoppers 6 move to the positions (solid lines) which permit shaft engagement and pawl motion, so that characters are selected on the even-numbered wheels 2.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A small printer for printing characters in a row on a printing paper, comprising:

a plurality of character wheels positioned to provide column positions in said row, each said character wheel having characters on its peripheral surface, a shaft rotatably supporting said character wheels thereon;

means for releasably engaging said character wheels individually with said shaft for rotation therewith;

means for selecting a character on each said wheel individually for printing, said selected characters being locked in a rotated position of said wheels for printing, locking a character in position for printing causing release of the associated character wheel from said rotational engagement with said shaft;

a plurality of actuating means, each said actuating means, when actuated, being capable of simultaneously operating an associated group of at least two said selecting and locking means;

blocking means for intermittently preventing rotation with said shaft of all but one of said characters wheels in said associated group, said blocking means causing release of said all but one character wheels from said rotational engagement with said shaft.

2. The small printer as claimed in claim 1, wherein said means for releasably engaging said character wheels with said shaft includes a spring member engaged at one end to said shaft and at the other end to said character wheel, and holding said shaft and wheel together by spring force.

3. A small printer as claimed in claim 2, wherein said means for selecting and locking a character on each said wheel individually includes a ratchet wheel fixed on the side of each said character wheel, and a selector pawl, said selector pawl being moveably mounted and being subject to engagement with a tooth of said raatchet wheel for selection of a character, said selector pawl locking said character wheel in said rotated position for printing by overcoming said spring force.

4. The small printer as claimed in claim 3, wherein said plurality of actuating means includes electromagnets, each said electromagnet being capable of operating said associated group simultaneously by driving associated selector pawls into said engagement.

5. The small printer as claimed in claim 4, wherein said blocking means comprises a stopper cooperating with each said group, said stopper being adapted to be in one of two positions, in the first position, said stopper being disengaged from said character wheels, ratchet wheels and pawls, in the second position, said stopper interfering with at least one of said ratchet and character wheels and preventing rotation of said at least one character wheel on said shaft, said spring force being overcome.

6. The small printer as claimed in claim 1 or 5, and further comprising means for pressing said printing paper against selected characters on said character wheels, said selected characters being arranged in said row at said position for printing.

7. The small printer as claimed in claim 6, wherein selection of characters is completed in substantially two revolution of said shaft, said blocking means being in said second position during said one revolution, on a second revolution of said shaft, said blocking means being in said first position, whereby different portions of said groups may be selected in each said revolution.

8. The small printer as claimed in claim 1 or 5, wherein said blocking means is further adapted to simultaneously block operation of said means for selecting and locking on each said character wheel prevented from rotation with said shaft by said blocking means.

9. The small printer as claimed in claim 3 or 5, wherein said blocking means impede the operation of said selector pawls associated with said character wheels prevented from rotation with said shaft.

10. The small printer as claimed in claim 9, and further comprising means for pressing said printing paper against selected characters on said character wheels, said selected characters being arranged in said row at said position for printing.

11. The small printer as claimed in claim 8, and further comprising means for pressing said printing paper against selected characters on said character wheels, said selected characters being arranged in said row at said position for printing.

* * * * *